United States Patent [19]

Bouk, deceased et al.

[11] 4,314,902

[45] Feb. 9, 1982

[54] CATALYTIC WATER WASH

[76] Inventors: Raymond S. Bouk, deceased, late of North Hollywood, Calif.; by Barbara Bouk, heir, 11344 Hatteras St., North Hollywood, Calif. 91503

[21] Appl. No.: 430,642

[22] Filed: Jan. 3, 1974

Related U.S. Application Data

[63] Continuation-in-part of Ser. No. 196,842, Nov. 8, 1971, abandoned, which is a continuation of Ser. No. 769,722, Oct. 22, 1968, abandoned.

[51] Int. Cl.[2] ..... C10G 19/02; C10G 27/00; C10G 29/12; A61L 1/00

[52] U.S. Cl. ..... 208/254 R; 422/28; 208/229; 208/230; 208/243; 208/244; 208/246; 208/247; 208/249; 208/283; 208/286; 208/292; 208/295; 208/296

[58] Field of Search ..... 208/196, 195, 202, 208 R, 208/243, 244, 246, 247, 249, 254 R, 283, 284, 286, 288, 291, 292, 226, 230, 229, 295, 296; 21/58

[56] References Cited

U.S. PATENT DOCUMENTS

| | | | |
|---|---|---|---|
| Re. 19,879 | 3/1936 | Lachman | 208/296 |
| 2,011,954 | 8/1935 | Teichmann | 208/196 |
| 2,042,052 | 5/1936 | Hoover | 208/195 |
| 2,042,053 | 5/1936 | Hoover | 208/195 |
| 2,457,635 | 12/1948 | Bond et al. | 208/195 |
| 2,792,334 | 5/1957 | Meguerian | 208/195 |
| 3,162,598 | 12/1964 | Disegna | 208/295 |

*Primary Examiner*—G. J. Crasanakis

[57] ABSTRACT

A process for eliminating and removing impurities including sulfur compounds and microorganisms as well as preventing further microbial contamination is accomplished by treating petroleum products or other hydrocarbon fluids with an aqueous solution of an oxidizing agent such as hydrogen peroxide or ozone together with a metallic ion catalyst, such as a mixture of ferric chloride and cupric chloride, where the metal ion is capable of forming activated oxygen complexes in the presence of such oxidizing agent, or by treatment with an aqueous solution of metallic ion catalyst and activated oxygen complexes formed from permanganate, peroxyborate or chromate ions.

12 Claims, No Drawings

CATALYTIC WATER WASH

CROSS-REFERENCE TO RELATED APPLICATIONS

This is a Continuation-In-Part of Ser. No. 196,842 filed Nov. 8, 1971, now abandoned, entitled "Catalytic Water Wash", which in turn was a continuation of Ser. No. 769,722 filed Oct. 22, 1968, now abandoned.

BACKGROUND OF THE INVENTION

The invention relates generally to a process of removing impurities from hydrocarbon or petroleum products, and more particularly, to a process of removing impurities from hydrocarbon fuels which includes the removal and prevention of microbial contamination.

Petroleum products may be purified by treatment with an oxidizing agent, such as sulfuric acid. In such a process, oxidation of impurities generally causes formation of an insoluble sludge, as well as soluble acid products which may be absorbed onto an absorbent material such as an activated clay. The use of hydrogen peroxide in addition to or as a substitute for the mineral acids in the oxidation process has also been suggested.

In addition to the naturally occurring impurities found in crude oil derivatives, which may be removed by oxidation of the oil, another impurity which has caused serious problems for the petroleum industry has been the presence and growth of microbial contamination. Such microbial activity has caused especially serious problems in jet aircraft fuel systems. The microbiological contamination of jet fuel can result in the plugging of filters which, when coupled with the high rate of fuel consumption of jet aircraft, may quickly cause malfunctioning of the fuel control system. Large amounts of sludge which causes such malfunctioning often results from the presence of bacteria and their matabolic by-products.

Microbial contamination is most pronounced in hydrocarbons such a jet fuels. Jet fuels, such as JP4, JP5 and JP6 generally contain a large percentage of kerosene or kerosene-type hydrocarbons. Such hydrocarbons, which are made up of paraffins with minor amounts of aromatics, are easily attached by microorganisms. Also, such fuels may contain minor amounts of olefins, sulfur, oxygen and nitrogen compounds, which for many microorganisms are essential for growth. Thus, the presence of these and other compounds in addition to the hydrocarbons when left in the fuel will result in more rapid microbial contamination.

One essential ingredient for the presence and growth of microorganisms is moisture. Kerosene or larger hydrocarbon-chain type fuels, being denser and more viscous than gasoline, have a greater tendency to entrain free water and hold it in suspension. Also, these fuels more readily form stable water emulsions. A wide range of microorganisms may exist in a hydrocarbon fuel in the presence of water. Several organisms can exist in a hydrocarbon environment with very little or perhaps no water, but in turn may produce additional water and by-products which allow the growth of an even more varied group of organisms. Thus, it can be seen that a hydrocarbon fuel, unless maintained in a completely anhydrous state, may, upon extended storage, be contaminated with a large amount of biological sludge.

The presence of microbial contamination may not only cause malfunctioning of the fuel system, but also has been attributed to fuel tank corrosion, since microorganisms may release corrosive by-products. Particularly serious corrosion problems have been encountered in integral fuel tank systems found in many jet aircraft. In such systems, the fuel is stored in the fuselage or wing section and is in direct contact with the aircraft metal. In addition, such integral fuel tank systems are often sealed with an elastomeric material such as acrylonitrilebutadiene (Buna-N) or polysulfides. These sealants themselves may provide the required nutrients for the growth of many microorganisms, as for example, sulfur organisms in polysulfide sealed tanks.

Although microbial contamination has caused the most serious problems in jet fuels and jet fuel systems and thus has been most extensively studied in this connection, it should be recognized that microbial contamination also occurs in other hydrocarbon and petroleum products such as gasolines and oils.

The microorganisms which may form in a hydrocarbon environment can include bacteria, fungi, protista yeast and mold. The bacteria which may be present may include heterotrophic bacteria, autotrophic bacteria, sheathed and stalked bacteria, and sulfur bacteria.

Heterotrophic bacteria are those microorganisms which require an organic carbon source and are unable to use carbon dioxide as the only source of carbon. A large number of heterotrophic bacteria have been found in fuel sludges, and they may include

*Baccillus megatherium* sp.
*Staphylococcus epidermitis* and var.
Pseudomonas sp.
Serratia sp.
Flavobacterium sp.
*Bacillus myocides*
*Bacillus subtilis*
*Aerobacter aerogenes*
Clestridium sp.
Coccus sp.
*Pseudomonas fluorescens*
Escherichia sp.

Autotrophic bacteria are microorganisms that can obtain energy from carbon dioxide alone in the presence of light, with such species as desulfovibrio, iron bacteria, and thiobacillus being found in fuel sludges.

The sheathed bacteria are bacterial cells surrounded by a sheath composed of an organic substance which may be impregnated with iron or manganese hydroxide. Of this class, galliomella species, caulobacter species, and sederocapsa species have been found in fuels. *T. thiooxidans, T. thioparus,* and *T. dentrificans* are examples of sulfur bacteria which may be found in fuel contamination.

As previously discussed, metallic corrosion may be caused by microorganisms. It has been demonstrated that such bacteria as Desulfovibrio sp.
Iron bacteria
Thiobacillus sp.

are involved in metallic corrosion. Corrosion, as well as much of the sludge formation, may result from the by-products of such microorgams. For example, a large variety of digestion related materials may be produced from such organisms, including enzymes, proteins, and fatty acids. These, in turn, may break down into simpler oxygen, nitrogen, sulfur, and carbon compounds. For example, oxygen containing by-products may include organic acids, alcohols, aldehydes, or ketones. Nitrogen containing by-products may include ammonia, amines, imides, amides, nitrates, and nitrites. The sulfur containing by-products from such microorganisms may include mercaptans, sulfides, disulfides, thioacids, dithioacids, thioaldehydes, and thiones as well as sulfur from the sulfur bacteria itself. The formation of such by-products results in extensive corrosion of a fuel tank.

Particular microorganisms, which are known to be associated with fuel and cutting oils, include

*Fusarium moniliforme*
Cladosporium (fungi species)
*Flavobacterium arborescens*
*Clostridium sporogenes*
*Desulfovibrio desulfuricans*
*Aerobacter aerogenes*
*Bacillus subtilis*
*Pseudomonas aeruginosa*
*Pseudomonas fluorescens*
*Cladosporium resinae*
Aeremonium
Fusarium
Alternaria
*Bacillus terminalis*
*Flavobacterium fulvum*
*Bacillus megaterium*
*Flavobacterium diffusum*
Achromobacter
*Pseudomonas oleovorans*
*Pseudomonas* (all species) *formicans*
*Salmonella schottmuelleri*
*Salmonella typhimurium*
*Salmonella oranienburg*
*Salmonella typhosa*
*Klebsiella pneumoniac*
Achromobacter sp
*Aerobacter aerogenes*
*Aerobacter cloacae*
*Diplococcus pneumoniae*
*Escherichia coli*
*Escherichia freundii*
*Escherichia intermedium*
*Micrococcus citreus*
*Micrococcus pyogenes var. albus*
*Micrococcus pyogenes var. aureus*
Paracolobactrum intermediates
*Proteus mirabilis*
*Proteus morganii*
Proteus sp
*Proteus vulgaris*
Sarcina sp
*Shigella madampenis*
*Streptococcus pyogenes,* alpha hemolytic
*Streptococcus pyogenes,* beta hemolytic
Yeast in addition to the fungi and bacteria listed above.

To date, the problem associated with microbial contamination caused by these organisms has been dealt with by attempting to minimize the amount of moisture condensing into the fuel, as well as limiting the amount of time that the fuel is stored, or utilizing high cost maintenance and housekeeping procedures, e.g., filtration, skimming, etc., or a wide array of additives to inhibit or slow the growth of such contamination or to counter the effects thereof. Treatment of fuels has in large been limited to the use of inhibitors, separation of natural impurities and by-products of microbial contamination, as opposed to the elimination and prevention of growth of the organisms themselves or their regrowth.

A major advantage of the process of this invention is that it provides a means of removing not only natural crude oil impurities and the by-products of microbiocidal growth, but also eliminates fuel-born microorganisms and prevents further growth and regrowth of the same.

An additional advantage of the present invention is that natural impurities generally separated during the oil refining process may be separated in a single process along with the microbial contaminants before, during or after the refining process for crude, distilled or otherwise fractionated petroleum products.

SUMMARY OF THE INVENTION

A process for removing impurities, including sulfur compounds, gums, waxes, microorganisms, and moisture from petroleum and other liquid hydrocarbon products, is accomplished by treating the product with an aqueous solution of an oxidizing agent and metallic ion catalyst comprising a mixture of metallic salts, said metal ion being capable of forming activated oxygen complexes in the presence of the oxidizing agent, or by treatment with an aqueous solution of an activated oxygen complex, formed from permanganate, peroxyborate or chromate ions, in combination with the metal ion catalyst.

More particularly, the process encompasses the treatment of hydrocarbon fluids such as gasoline, kerosene, jet fuels, hydraulic fluids, transformer oils, cutting oils and other natural and synthetic hydrocarbon fluids to remove unwanted impurities including microorganisms and to prevent microbial recontamination by elimination of the life support system for such organisms.

In a particularly preferred form, the fluids are treated with an aqueous solution of hydrogen peroxide and an aqueous solution of a metallic ion catalyst consisting of a mixture of cupric chloride and ferric chloride salts. After treatment, the aqueous solutions are removed along with the separated impurities. Results indicate that microbial growth will not occur in the treated fluids.

DESCRIPTION OF THE PREFERRED EMBODIMENT

It is elementary biology that all living systems require water for their existence. In general, living organisms, including bacteria, require that the nutrients upon which they are dependent be in solution so they can pass through the cell wall and be of benefit. Thus, although organisms may not consume moisture for growth, they may require it for the dissolution of vital nutrients.

In the absence of moisture, the existence and especially the growth of microorganisms present little problem. On the other hand, some species, as spores, may exist in a dormant state for long periods of time in relatively dry conditions. Then, upon the availability of sufficient moisture, they may germinate into active, viable microorganisms, which in turn may produce more moisture and nutrients for further microbial growth. Likewise, fungi may exist under relatively arid conditions and produce vegatative growth in the arid environment. Some species of fungi are able to further their growth by the production of metabolic water.

In the case of hydrocarbon fuels, bacteria and fungi may grow in the water layer formed beneath the less dense hydrocarbon fuel at the interface. Additionally, fuel-water emulsification may occur within the molecular structure of the fuel which greatly increases the hydrocarbon-water interface area within the fuel itself which results in increased microbial growth. Such water emulsification is most predominant in dense, viscous hydrocarbons such as kerosenes and oils in which the heavier water may not settle out into a separate phase. By the same token, water, especially metabolic water, may also be found in hydrocarbon fluids in the form of dissolved water.

The oxidative capability of hydrogen peroxide has long been known. Likewise, it has been known that metal ions such as copper, in the presence of hydrogen peroxide, result in the formation of free radical peroxide ions, Sacrez and Leroux, *C.R. Soc. Biol., Paris* Vol. 141, p.494, (1947). It has now been discovered that the addition of an aqueous solution of metal ions, such as copper, to an aqueous oxidizing solution such as hydrogen peroxide enhances the oxidative ability of the system. Such enhanced activity results in a marked increase in biocidal effects due, in part, to the formation of peroxide free radicals from the reaction between the metal ions and the oxidizing agent. In addition, various unwanted impurities such as unsaturated olefinic compounds, sulfur, oxygen and nitrogen containing compounds may be oxidized and separated into a water phase. Generally, 25 to 200 ml of a 10% by volume aqueous solution of hydrogen peroxide per 1000 ml of petroleum product is utilized, and preferably about 100 ml 10% hydrogen peroxide per 1000 ml of petroleum product.

Even greater oxidizing activity has been found to occur in hydrocarbon systems from a mixture of metal ions. Generally, by combining metal ions from Groups Ib, IVa, or Va of the Periodic Table (from the Sixth Edition of the Merck Index) with metal ions from Groups Ia, IIa, and the transition elements of Group VIII, even more effective hydrocarbon purification occurs than when a single metal ion is used to catalyze the oxidation reaction. More particularly, elements such as copper, gold, silver, lead, tin, antimony, arsenic, and bismuth in combination with metal ions selected from the group consisting of potassium, sodium, barium, calcium, strontium, cobalt, iron or nickel, when used with an oxidizing agent such as hydrogen peroxide or ozone, may be utilized to remove unwanted impurities including microorganisms and their by-products. Generally about 1.75 to 10 ml of a 10 to 0.1 N solution of salts per 1000 ml of petroleum or other hydrocarbon product are contemplated for use in this invention, preferably 1 N to 0.1 N, although larger or smaller quantities may in certain instances be desirable. This removal results in purification of the system so that microbial growth cannot occur. Specifically, by treating the petroleum product with hydrogen peroxide in an aqueous solution in the presence of a metallic ion catalyst which is also in an aqueous solution, unwanted impurities including sulfur compounds, gums, microorganisms, as well as the moisture and nutrients upon which microorganisms are dependent are removed. After treatment with this unique catalytic water wash, the petroleum product may be contacted with an activated clay or other adsorbent material or otherwise separated from the water phase and filtered to remove all the residual moisture and impurities, including microorganisms, which are now contained in the aqueous phase.

SPECIFIC EXAMPLES

EXAMPLE I

A water solution of 30 percent hydrogen peroxide was diluted with two volumes of water. To 100 parts by volume of this diluted hydrogen peroxide solution was added 5 parts by volume of aqueous cupric chloride solution (0.0276 grams $CuCl_2$ per ml. solution) and 5 parts by volume of aqueous ferric chloride solution (0.150 grams $FeCl_3$ per ml. solution). When compared to the rate of decomposition of the hydrogen peroxide in the presence of cupric chloride or the ferric chloride alone, the rate of decomposition of this solution containing both cupric chloride and ferric chloride was three times as great as when either catalyst was used separately.

EXAMPLE II

As an example of this process for application to crude petroleum, the reagents of Example I was used to treat what is known as Slick Creek crude. This crude having a 46 Baume specific gravity and containing 18 percent sulfur was treated with the reagents of Example I in which 10 volumes of the petroleum was treated with about 1 volume of the 10 percent hydrogen peroxide solution to which was added 5 percent by volume of aqueous cupric chloride solution (containing 0.0276 grams CuCl per ml. solution) and 5 percent by volume of aqueous ferric chloride (containing 0.150 grams FeCl per ml. of solution), the ingredients being added separately. The mixture was agitated by stirring, and after a period of ten to fifteen minutes the insoluble impurities in the form of a tarry and waxy residue were separated. After the reaction of the hydrogen peroxide had been completed, an absorbant clay in the amount of about 3 percent by weight was added to the mixture, and any additional insoluble impurities were filtered out. The filtrate was then washed-with water four times to remove the water soluble impurities, particularly soluble sulfonates; after this treatment the product was separated by distillation into fractions which consisted of a gasoline cut equal to 50.5 percent, a kerosene cut equal to 11.5 percent, a gas oil cut equal to 22 percent, and a residue of 16 percent. The separate fractions were then analyzed with the following results:

The gasoline cut as of 54.4 A.P.I. gravity, and showed a sulfur content of 0.29 percent by weight. The hydrocarbon type analysis (by silica gel) showed 23.5 percent by volume aromatics, 0.5 percent olefins, and 76 percent paraffins and naphthenes. The octane rating (F 1 plus 3 cc. Tol) was 71.4. The A.S.T.M. distillation test showed (degrees F.):

| St. | 10 | 30 | 50 | 70 | 90 | 95 | 61 | Recovery |
|---|---|---|---|---|---|---|---|---|
| 142 | 196 | 240 | 270 | 303 | 340 | 352 | 366 F | 99% |

The kerosene cut had an A.P.I. gravity of 38.8, and a sulfur content of 0.77 percent by weight. The hydrocarbon type analysis (by slica gel) indicated aromatics 28.5 percent by volume, olefins 4.5 percent by volume, paraffins and naphthenes 67 percent by volume. The A.S.T.M. distillation test showed (degrees F.):

| St. | 10 | 30 | 50 | 70 | 90 | 95 | EP | Recovery |
|---|---|---|---|---|---|---|---|---|
| 400 | 410 | 416 | 422 | 430 | 450 | — | 470 | 99% |

The gas oil cut showed a sulfur content of 1.06 percent. The cleanup of this crude through a single treatment by my process is by itself remarkable. A repeated treatment of each fraction would remove even more impurities such as sulfur, as illustrated in Example III.

EXAMPLE III

A white gasoline (Richfield) was purchased at a service station and an analysis of this material showed the sulfur content to be 0.06 percent. Ten volumes of this white gas was treated with 1 volume of the reagent mixture set forth in Example 1, the ingredients being added separately. The mixture was agitated, and at the end of ten minutes the hydrogen peroxide had ceased to evolve oxygen, and residue consisting of tarry and waxy materials had separated from the clear gasoline. About 5 percent by weight of an adsorbent clay (Filtrol GR 13) was then mixed into the liquid containing the gasoline. Residue had settled on the bottom from the treatment, and the liquid was filtered. An analysis of the treated gasoline showed no measurable sulfur after the gasoline had been thoroughly water-washed to remove soluble impurities.

EXAMPLE IV

By the use of the hydrogen peroxide and catalysts in the proportions given in Example II, a sample of jet fuel was purified to the extent that no trace of wax, rag, lace, or sulfonates could be observed by the standard tests for jet fuel. In particular, the removal of all water soluble sulfonates and the like compounds which are oxidized by the hydrogen peroxide, eliminates the subsequent adsorption of water by the jet fuel so that microbial contamination will not occur upon storage.

EXAMPLE V

Alternatively, other metal ions and oxidizing agents may be added to improve the rate of evolution of active oxygen. For example, 10 volumes of white gasoline were treated with 2 percent by volume of hydrogen peroxide solution (10 percent) to which was added separately ½ percent cupric chloride solution (containing 0.0276 grams $CuCl_2$ per ml. of solution) and ½ percent of ferric chloride solution (containing 0.150 grams of $FeCl_3$ per ml. of solution). There was also added about ½ percent of potassium permanganate and ½ percent of sodium perborate. This mixture when stirred liberated oxygen rapidly, and the impurities of the white gasoline were eliminated in the form of tarry and waxy residue, and the sulfur content of the gasoline was oxidized to water soluble sulfonates and other water soluble compounds containing sulfur. After the reaction was complete, about 4 percent by weight of an adsorbent clay (Filtrol GR 13) was added and the tarry, waxy residue with the excess water and reagents were removed and the gasoline washed with water until free from water soluble constituents. The gasoline so produced had no measurable sulfur content and was free from wax by the standard test for jet fuel.

EXAMPLE VI

Twenty of twenty-four 500 ml. samples of JP4 and kerosene fuel were treated with varying amounts of $H_2O_2$, $CaCl_2+FeCl_3$, after which 10 ml. was streaked onto agar plates. All hydrogen peroxide solutions were 10% by volume, the cupric chloride solutions were made up of 0.0276 gms/ml of solution while the ferric chloride solution was made up of 0.150 gms/ml of solution. The remaining four untreated samples served as controls. The results are summarized in Table I.

TABLE I

| | JP-4 | | | | | | | | KEROSENE | | | | | | | |
|---|---|---|---|---|---|---|---|---|---|---|---|---|---|---|---|---|
| | BUSHNELL-HAAS AGAR | | | | NUTRIENT AGAR | | | | BUSHNELL-HAAS AGAR | | | | NUTRIENT AGAR | | | |
| Sample | 1 | 2 | 3 | 4 | 1 | 2 | 3 | 4 | 1 | 2 | 3 | 4 | 1 | 2 | 3 | 4 |
| Control | – | – | – | – | – | – | – | – | – | – | – | – | – | + | – | – |
| $H_2O_2$ - 12.5 ml<br>$CuCl_2$ - 0.875 ml<br>$FeCl_3$ - 0.875 ml | – | – | – | – | – | – | – | – | – | – | – | – | – | + | + | – |
| $H_2O_2$ - 25 ml<br>$CuCl_2$ - 1.25 ml<br>$FeCl_3$ - 1.25 ml | – | – | – | – | – | – | – | – | – | – | – | – | – | – | – | + |
| $H_2O_2$ - 50 ml<br>$CuCl_2$ - 2.5 ml<br>$FeCl_3$ - 2.5 ml | – | – | – | – | – | – | – | – | – | – | – | – | – | – | – | – |
| $H_2O_2$ - 75 ml<br>$CuCl_2$ - 3.75 ml<br>$FeCl_3$ - 3.75 ml | – | – | – | – | – | – | – | – | – | – | – | – | – | – | – | +* |
| $H_2O_2$ - 100 ml<br>$CuCl_2$ - 5.0 ml<br>$FeCl_3$ - 5.0 ml | – | – | – | – | – | – | – | +* | – | – | – | – | – | – | – | – |

– No Growth
+ Colony Growth
*These plates appear to be contaminated either during handling or exposed to the atmosphere after streaking; results were disregarded.

EXAMPLE VII 10 ml. of the samples of example VI were added to test tubes containing bushnell, Haas, nutrient, tryptose phosphate and blood and heart infusion broths. After 8 weeks, a cloudy material developed at the interface, which upon microscopic examination, showed no sign of microbial growth.

EXAMPLE VIII

The degree of emulsification between fuels and various nutrient broths as prepared in example VII is summarized in Table II. Since a minimum aqueous fuel interface area minimizes microbial growth, it is desirable to prevent fuels-water emulsification. After treatment by this process, water may be reintroduced into the treated product, if desired, without the danger of bacterial recontamination.

fuel samples showed serious corrosion after only two months.

TABLE II

| | BUSHNELL-HAAS | | | | | | NUTRIENT | | | | | | TRYPTOSEPHOSPHATE | | | | | | BRAINHEART INFUSION | | | | | |
|---|---|---|---|---|---|---|---|---|---|---|---|---|---|---|---|---|---|---|---|---|---|---|---|---|
| | JP-4 | | | KEROSENE | | | JP-4 | | | KERO-SENE | | | JP-4 | | | KEROSENE | | | JP-4 | | | KEROSENE | | |
| Samples | 1 | 2 | 3 | 1 | 2 | 3 | 1 | 2 | 3 | 1 | 2 | 3 | 1 | 2 | 3 | 1 | 2 | 3 | 1 | 2 | 3 | 1 | 2 | 3 |
| Control | – | – | + | – | – | – | – | – | – | + | + | + | + | + | + | + | + | – | ++ | ++ | + | ++ | ++ | + |
| $H_2O_2$ - 12.5 ml $CuC_2$ - 0.875 ml $FeCl_3$ - 0.875 ml | – | – | – | – | – | – | + | + | + | + | + | + | + | + | + | + | + | + | + | + | – | + | – | – |
| $H_2O_2$ - 25 ml $CuCl_2$ - 1.25 ml $FeCl_3$ - 1.25 ml | – | – | – | – | – | – | – | – | – | – | – | + | + | + | – | – | + | – | + | – | – | + | + | – |
| $H_2O_2$ - 50 ml $CuCl_2$ - 2.5 ml $FeCl_3$ - 2.5 ml | + | – | – | – | – | – | – | – | – | – | – | – | – | ++ | + | – | ++ | – | – | – | – | + | – | – |
| $H_2O_2$ - 75 ml $CuCl_2$ - 3.75 ml $FeCl_3$ - 3.75 ml | + | – | + | – | – | + | – | – | – | – | – | – | + | – | – | – | + | + | – | – | – | – | – | – |
| $H_2O_2$ - 100 ml $CuCl_2$ - 5.0 ml $FeCl_3$ - 5.0 ml | + | ++ | ++ | ++ | ++ | – | + | + | + | + | + | – | – | – | – | – | – | – | – | – | – | – | – | – |

No Microbiological growth present
+ Emulsification
++ Excessive Emulsification
– No Emulsification

EXAMPLE IX

A series of tests were performed wherein two strips of alluminum, one T2024 and one T7076T76 were emmersed in 400 cc. of the fuel samples as prepared in example VI. After two years, there was no visible corrosion whereas strips immersed in untreated control

EXAMPLE X

Fuel samples were tested using the solution makeups as in example VI in which the hydrogen peroxide concentrations were kept constant while the cupric chloride and ferric chloride concentrations were varied. The results are summarized in Table III.

TABLE III

| | JP-4 | | | | | | | | KEROSENE | | | | | | | |
|---|---|---|---|---|---|---|---|---|---|---|---|---|---|---|---|---|
| | BUSHNELL-HAAS AGAR | | | | NUTRIENT AGAR | | | | BUSHNELL-HAAS AGAR | | | | NUT. AGAR | | | |
| Sample | 1 | 2 | 3 | 4 | 1 | 2 | 3 | 4 | 1 | 2 | 3 | 4 | 1 | 2 | 3 | 4 |
| | | | | | | Series 1 | | | | | | | | | | |
| Control | – | – | – | – | – | – | – | – | – | – | – | – | – | – | – | – |
| $H_2O_2$ - 12.5 ml $CuCl_2$ - 1.0 ml $FeCl_3$ - 1.0 ml | – | – | – | – | – | – | – | – | – | – | – | – | – | – | – | – |
| $H_2O_2$ - 12.5 ml $CuCl_2$ - 3.0 ml $FeCl_3$ - 3.0 ml | – | – | – | – | – | – | – | – | – | – | – | – | – | – | – | – |
| $H_2O_2$ - 12.5 ml $CuCl_2$ - 4.0 ml $FeCl_3$ - 4.0 ml | – | – | – | – | – | – | – | – | – | – | – | – | – | – | – | – |
| | | | | | | Series 2 | | | | | | | | | | |
| Control | – | – | – | – | – | – | – | – | – | – | – | – | – | – | – | – |
| $H_2O_2$ - 50 ml $CuCl_3$ - 1.0 ml $FeCl_3$ - 1.0 ml | – | – | – | – | – | – | + | + | – | – | – | – | – | – | + | + |
| $H_2O_2$ - 50 ml $CuCl_2$ - 3.0 ml $FeCl_3$ - 3.0 ml | – | + | – | – | – | – | – | – | – | – | – | – | – | – | – | – |
| $H_2O_2$ - 50 ml | | | | | | | | | | | | | | | | |

TABLE III-continued

| | JP-4 | | | | | | | | KEROSENE | | | | | | | |
|---|---|---|---|---|---|---|---|---|---|---|---|---|---|---|---|---|
| | BUSHNELL-HAAS AGAR | | | | NUTRIENT AGAR | | | | BUSHNELL-HAAS AGAR | | | | NUT. AGAR | | | |
| Sample | 1 | 2 | 3 | 4 | 1 | 2 | 3 | 4 | 1 | 2 | 3 | 4 | 1 | 2 | 3 | 4 |
| $CuCl_2$ - 5.0 ml<br>$FeCl_3$ - 5.0 ml | – | – | – | – | – | – | – | – | – | – | – | – | – | – | – | – |
| | | | | | | | Series 3 | | | | | | | | | |
| Control | – | – | – | – | – | – | – | – | – | – | – | – | – | – | – | – |
| $H_2O_2$ - 100 ml<br>$CuCl_2$ - 1.0 ml<br>$FeCl_3$ - 1.0 ml | – | – | – | – | – | – | – | – | – | – | – | – | – | – | – | – |
| $H_2O_2$ - 100 ml<br>$CuCl_2$ - 3.0 ml<br>$FeCl_3$ - 3.0 ml | – | – | – | – | – | – | – | – | – | – | – | – | – | – | – | – |
| $H_2O_2$ - 100 ml<br>$CuCl_3$ - 5.0 ml<br>$FeCl_3$ - 5.0 ml | – | – | – | – | – | – | – | – | – | – | – | – | – | – | – | – |

– No Growth
+ Colony Growth

EXAMPLE XI

The samples prepared for example X were tested for emulsification as in example VIII. The results are summarized in Table IV.

TABLE IV

| | BUSHNELL-HAAS | | NUTRIENT | | TRYPTOSE PHOSPHATE | | BRAIN & HEART INFUSION | |
|---|---|---|---|---|---|---|---|---|
| | JP-4 | KEROSENE | JP-4 | KEROSENE | JP-4 | KEROSENE | JP-4 | KEROSENE |
| | | | | Series 1 | | | | |
| Control | – | – | – | + | – | – | ++ | ++ |
| $H_2O_2$ - 12.5 ml<br>$CuCl_2$ - 1.0 ml<br>$FeCl_3$ - 1.0 ml | – | – | + | + | + | + | + | + |
| $H_2O_2$ - 12.5 ml<br>$CuCl_2$ - 3.0 ml<br>$FeCl_3$ - 3.0 ml | + | – | + | – | + | + | + | ++ |
| $H_2O_2$ - 12.5 ml<br>$CuCl_2$ - 5.0 ml<br>$FeCl_3$ - 5.0 ml | + | ++ | + | + | + | + | – | – |
| | | | | Series 2 | | | | |
| Control | – | – | – | – | – | – | – | – |
| $H_2O_2$ - 50 ml<br>$CuCl_2$ - 1.0 ml<br>$FeCl_3$ - 1.0 ml | – | – | – | – | – | + | + | + |
| $H_2O_2$ - 50 ml<br>$CuCl_2$ - 3.0 ml<br>$FeCl_3$ - 3.0 ml | – | – | + | + | ++ | ++ | – | – |
| $H_2O_2$ - 50 ml<br>$CuCl_2$ - 5.0 ml<br>$FeCl_3$ - 5.0 ml | + | – | + | ++ | + | ++ | – | – |
| Control | – | – | – | – | – | – | – | – |
| $H_2O_2$ - 50 ml<br>$CuCl_3$ - 1.0 ml<br>$FeCl_3$ - 1.0 ml | + | + | + | + | + | + | + | + |
| $H_2O_2$ - 100 ml<br>$CuCl_2$ - 3.0 ml<br>$FeCl_3$ - 3.0 ml | + | + | + | + | + | + | + | + |
| $H_2O_2$ - 100 ml<br>$CuCl_2$ - 5.0 ml<br>$FeCl_3$ - 5.0 ml | ++ | ++ | ++ | + | – | – | – | – |

No microbiological growth
+ Emulsification
++ Excessive Emulsification
– No Emulsification

EXAMPLE XII

Six samples of 500 cc each, three JP4 and three of kerosene, were prepared. One JP4 and one kerosene were filtered untreated through a millipore filter. The other four (two JP4 and two kerosene) were treated with the process and then filtered. Two samples, one each of the different fuels were treated with the lowest concentration levels of $H_2O_2$ (12.5% $H_2O_2$) considered effective, and two samples of each of the fuels treated with the next higher concentration levels (25% $H_2O_2$). The treatment also included 1.75 ml. of $CuCl_2+FeCl_3$ solution as made up in Example VI. Each one of the filter pads used for the six samples was then placed in a sterilized flask containing 500 cc of a mixture of Bushnell-Hass, Soy and Tryptose Phosphate broth. The filter pads were used to determine extent of microbial contamination.

The two flasks containing the filter pads from the untreated fuel developed microbial contamination after two days of incubation. Two other flasks containing the treated kerosene filter pads also showed the same microbial invasion. The flasks containing the pads from the treated JP4 fuel were clear after the same period of incubation. These flasks were allowed to incubate for several more days; they were still clear during the prolonged incubation period.

From examples V to XII, acceptable concentration levels for the purification of 1000 ml of JP4 fuel are: 25 ml. of hydrogen peroxide (10% by volume); 1.75 ml. of cupric chloride at 0.0276 gm/ml.; and 1.75 ml. of ferric chloride at 0.150 gm/ml.

It is important that an excess of the hydrogen peroxide reagent be used to effect complete elimination of the undesired impurities with the optimum amounts of reagents dependent upon the particular distillate or product to be treated.

Petroleum fuel fractions when properly treated by my process will easily pass the standard A.S.T.M. test, M.I.L.F. 5624-JP4 for gum content, showing less than one-fourth the permissible minimum gum content of 7 mgs. per 100 ml.

Ozone gas may be substituted for hydrogen peroxide in the above examples, the proportion being based upon an equivalent amount of the active oxygen liberated, to give the same results in purifying petroleum products. Similarly, as indicated previously, compounds such as alkali metal chromates, permanganates and peroxyborates may be used as the oxidizing agent. When such a compound is used in an aqueous solution, the compound itself dissolves and forms the activated oxygen complex which then functions together with the metallic ion catalyst to effect the desired elimination and removal of the objectionable impurities. Where hydrogen peroxide or ozone, however, is used as the oxidizing agent, such agent forms the desired activated oxygen complex, i.e. peroxide free radicals, with the metal ions of the metallic ion catalyst to effect the desired elimination and removal.

The advantages of this invention will be apparent to those familiar with the art of removing gum, sulfur, and other impurities from petroleum distillates. The sulfur may be reduced to a negligible quantity, so low that it is not indicated by the standard tests. As contrasted with the usual treatment of distillates by sulfuric acid, the fractions treated by the process of this invention were higher in aromatics and therefore were upgraded over the gasoline and kerosene produced by the usual sulfuric acid process. In addition to the advantages of low sulfur content and the retention of the maximum amount of the aromatic constituents of the original crude distillate, the cost of treatment by my process is lower and the treatment of jet fuels greatly decreases the formation of sludge and microbial contamination associated with such fuels and storage tank corrosion.

In addition to the advantages enumerated above, it has been found that petroleum products treated by the process of this invention enjoy a longer storage life as well as increased net heat of combustion and thermal stability. Also, as is apparent from the illustrative examples, the treatment process is ordinarily carried out at ambient temperature, although in instances where highly viscous crude petroleum products and very high temperature distillates (those fractionated at a temperature above the bottom hole temperature of the original crude) are treated, it may be necessary to dilute the product, to heat the same to a temperature below the well bottom temperature, or to utilize an emulsifying agent to facilitate obtaining intimate mixing with the aqueous solution. Further advantages of this invention are the ability to produce non-corrosive hydraulic and transformer oils or fluids and also elimination of the use of chemical additives in the treatment of petroleum products, which possess inherent limitations in that the additives necessarily have to be consumed or otherwise removed from the product.

As especially significant advantage of the present invention has been found in the purification of petroleum fuels to reduce objectionable nitrogen oxide emissions. As is well known, the oxides of nitrogen are the class of air pollutants from combustion sources which present the most difficult problem in terms of a mechanical solution and reduction of toxic air pollutant formation. Although smoke, unburned hydrocarbons and even carbon monoxide can be converted into carbon dioxide by mechanical alterations in the combustion source, such mechanical alterations invariably cause an increase in the concentration of nitric oxide formed during combustion. While nitric oxide itself is not toxic, in the presence of atmospheric oxygen, it participates in chemical reactions to produce nitrogen dioxide and other nitrogen oxides. Moreover, if moisture is present, nitrous and nitric acids are formed and, with sunlight, ozone and peroxyacetyl nitrates are produced, all of which are toxic to both animal and plant life. It has been found, however, that when gasoline was subjected to the treatment process of this invention before combustion, nitrogen oxide exhaust emissions decreased, as shown by the table which follows, in a range between 42% and 9% depending upon the brand of gasoline treated.

CHANGES IN NITROGEN OXIDE EMISSION DUE TO TREATMENT OF FUEL PRIOR TO COMBUSTION

| Fuel Sample | Change (%) |
|---|---|
| 1 | −24 |
| 2 | −11 |
| 3 | −9 |
| 4 | −9 |
| 5 | −14 |
| 6 | −10 |
| 7 | −42 |

Although the explanation for the improved results of this process may not be completely known, in contrast to what has been previously understood, it is believed that the microbial infestation of petroleum and other hydrocarbon fluids does not solely signify the presence of contamination but rather represents the natural state of the product. It is thus believed that the microorganisms found in such products are native thereto, i.e., "petroleum-born", and maintain complete life support systems within the product through conversion of the hydrocarbon compounds into a range of metabolic by-products. Chemical additives which have been used previously for the purification of petroleum products, however, merely attack such by-products and do not eliminate the microorganisms but merely compound the problems of storage, use, etc. since the microorganisms are capable of adapting the additives into their life support systems. In contrast to the approaches previously taken the present invention eliminates such microbiological organisms by use of the defined aqueous solution of oxidizing agent and metallic ion catalyst which is believed to serve as a means of dissolving or softening the gelatinous mucoidal structures, thereby lowering their defense mechanisms and permitting the hydrogen peroxide and other chemicals to be ingested and thereby destroy the organisms. Moreover, since the treatment process described herein eliminates and removes the viable forms of the organisms, the highly desirable results of decreased nitrogen oxide emissions can be achieved by treatment of the crude petroleum product as well as by treatment of the gasoline or other fuel fraction prior to combustion. Similarly, due to the removal of such organisms and their by-products, unburned hydrocarbons, smoke and foreign particulate matters are substantially decreased, as are polymer formation and coking.

What is claimed is:

1. A process of eliminating impurities including viable forms of microbial contamination and preventing microbial recontamination in liquid hydrocarbons comprising treating said hydrocarbons with an aqueous solution comprising an oxidizing compound and a mixture of metallic salts in which a first salt contains a metal ion selected from groups IB, IVa and Va of the periodic table and a second salt contains a metal ion selected from groups Ia, IIa and VIII of the periodic table, said aqueous solution reacting with and causing separation of said impurities from the liquid hydrocarbon into the aqueous solution, and subsequently removing said aqueous solution containing said impurities from the treated liquid hydrocarbon.

2. The process of claim 1 wherein said oxidizing compound is selected from the group consisting of hydrogen peroxide, chromates, permanganates, peroxyborates and ozone.

3. The process of claim 2 wherein said first salt contains metal ions selected from the group consisting of copper, gold, silver, lead, tin, antimony, arsenic and bismuth and said second salt contains metal ions selected from the group consisting of potassium, sodium, barium, calcium, strontium, cobalt, iron and nickel.

4. A process of eliminating impurities including viable forms of microbial contamination in a liquid petroleum product comprising treating said petroleum product with an aqueous solution comprising hydrogen peroxide and a metallic salt catalyst comprising a mixture of cupric chloride and ferric chloride, said aqueous solution reacting with and causing separation of said impurities from the liquid petroleum product into the aqueous solution, and subsequently removing said aqueous solution containing said impurities from the treated petroleum product.

5. The process of claim 4 which includes the steps of adding an adsorbant to the treated petroleum mixture of said product and then filtering the product and adsorbant to remove impurities therefrom.

6. A process of treating hydrocarbon fuels and oils including jet fuels to remove and prevent microbial contamination comprising the steps of treating such hydrocarbon product with a 10% by volume aqueous solution comprising hydrogen peroxide and a metallic salt catalyst comprising a mixture of 1.75 to 10 ml. per 1000 ml. of hydrocarbon product of a 0.0276 gm/ml. aqueous solution of cupric chloride and 1.75 to 10 ml. per 1000 ml. of hydrocarbon product of a 0.150 gms/ml aqueous solution of ferric chloride, said aqueous solution reacting with and causing separation of impurities including said microbial contamination from the hydrocarbon product into said aqueous solution, and subsequently removing said aqueous solution containing said impurities from the treated petroleum product.

7. A process of treating jet fuels to remove and prevent microbial contamination comprising the steps of treating the such jet fuel with approximately 25 ml. per 1000 ml of fuel of a 10% by volume aqueous solution comprising hydrogen peroxide and a metallic salt catalyst comprising a mixture of approximately 1.75 ml per 1000 ml. of fuel of a 0.0276 gm/ml aqueous solution of cupric chloride and approximately 1.75 ml per 1000 ml. of fuel of a 0.150 gms/ml aqueous solution of ferric chloride, said aqueous solution reacting with and causing separation of impurities including said microbial contamination from the fuel into the aqueous solution, and subsequently removing the aqueous solution containing said impurities from said fuel.

8. The process of claim 7 which includes the steps of adding an adsorbant to the treated petroleum mixture of said product and then filtering the product and adsorbant to remove impurities therefrom.

9. The process of claim 4 in which petroleum born contamination is eliminated by said treatment process.

10. The process of claim 4 in which said treatment is carried out at ambient temperature.

11. A process of reducing nitrogen oxide emissions resulting from combustion of gasoline comprising treating a gasoline product prior to combustion thereof with an aqueous solution comprising an oxidizing compound and a mixture of metallic salts in which a first salt contains a metal ion selected from groups Ib, IVa and Va of the periodic table and a second salt contains a metal ion selected from groups Ia, IIa and VIII of the periodic table, said aqueous solution reacting with and causing separation of nitrogen from such gasoline product into the aqueous solution, and thereafter removing said aqueous solution containing said nitrogen from such gasoline.

12. The process of claim 11 in which said oxidizing compound is hydrogen peroxide and said mixture of metallic salts are cupric chloride and ferric chloride.

* * * * *